US009172194B2

(12) United States Patent
Maruyama et al.

(10) Patent No.: US 9,172,194 B2
(45) Date of Patent: Oct. 27, 2015

(54) COAXIAL CONNECTOR PLUG

(71) Applicant: MURATA MANUFACTURING CO., LTD., Nagaokakyo-shi, Kyoto-fu (JP)

(72) Inventors: Takashi Maruyama, Kyoto-fu (JP); Yukihiro Kitaichi, Kyoto-fu (JP); Shinichi Kenzaki, Kyoto-fu (JP); Hiroki Wakamatsu, Kyoto-fu (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 128 days.

(21) Appl. No.: 13/661,898

(22) Filed: Oct. 26, 2012

(65) Prior Publication Data

US 2013/0115810 A1 May 9, 2013

(30) Foreign Application Priority Data

Nov. 4, 2011 (JP) ..... 2011-242324

(51) Int. Cl.

| | |
|---|---|
| ***H01R 12/00*** | (2006.01) |
| ***H01R 24/38*** | (2011.01) |
| ***H01R 24/50*** | (2011.01) |
| *H01R 13/405* | (2006.01) |

(52) U.S. Cl.

CPC ..... *H01R 24/38* (2013.01); *H01R 24/50* (2013.01); *H01R 13/405* (2013.01)

(58) Field of Classification Search

CPC ..... H01R 2201/02; H01R 24/38
USPC ..... 439/63, 578, 916, 944
See application file for complete search history.

(56) References Cited

U.S. PATENT DOCUMENTS

| | | | | |
|---|---|---|---|---|
| 5,466,160 | A | 11/1995 | Ogura | |
| 5,879,190 | A * | 3/1999 | Maruyama et al. | 439/582 |
| D675,162 | S * | 1/2013 | Kenzaki et al. | D13/133 |
| 8,678,836 | B2 * | 3/2014 | Kenzaki et al. | 439/63 |
| 2004/0137764 | A1 | 7/2004 | Yamane | |
| 2006/0009075 | A1 | 1/2006 | Nagata et al. | |
| 2006/0024985 | A1 | 2/2006 | Nagata et al. | |
| 2008/0293297 | A1 * | 11/2008 | Wakamatsu et al. | 439/581 |

(Continued)

FOREIGN PATENT DOCUMENTS

| | | | |
|---|---|---|---|
| CN | 100373708 | C | 3/2008 |
| JP | 06-021303 | A | 1/1994 |

(Continued)

OTHER PUBLICATIONS

An Office Action; "Notification of Reasons for Rejection," issued by the Japanese Patent Office on Oct. 1, 2013, which corresponds to Japanese Patent Application No. 2011-242324 and is related to U.S. Appl. No. 13/661,898; with English translation.

(Continued)

*Primary Examiner* — James Harvey
(74) *Attorney, Agent, or Firm* — Studebaker & Brackett PC

(57) ABSTRACT

An outer conductor has a substantially cylindrical shape extending in an axial direction. A center conductor has a substantially cylindrical shape extending in the axial direction, and is provided inside the outer conductor. An insulator fixes the center conductor relative to the outer conductor. The center conductor is provided with a hole that communicates with the inside and the outside of the center conductor. The insulator extends, via the hole, to the inside of the center conductor from the outside.

11 Claims, 9 Drawing Sheets

(56) References Cited

U.S. PATENT DOCUMENTS

| | | | | |
|---|---|---|---|---|
| 2009/0042440 | A1 | 2/2009 | Michelmann et al. | |
| 2010/0190376 | A1 | 7/2010 | Chen et al. | |
| 2012/0122339 | A1 | 5/2012 | Taguchi | |
| 2013/0115810 | A1* | 5/2013 | Maruyama et al. | 439/578 |
| 2013/0143437 | A1* | 6/2013 | Kenzaki et al. | 439/578 |

FOREIGN PATENT DOCUMENTS

| | | | |
|---|---|---|---|
| JP | 08-172140 | A | 7/1996 |
| JP | H08-185935 | A | 7/1996 |
| JP | 2004-221055 | A | 8/2004 |
| JP | 2009-104836 | A | 5/2009 |
| JP | 2010-020948 | A | 1/2010 |
| TW | 200614604 | A | 5/2006 |
| TW | 200618394 | A | 6/2006 |
| TW | I260115 | B | 8/2006 |
| TW | I272745 | B | 2/2007 |
| TW | M327109 | U | 2/2008 |
| WO | 2011/013747 | A1 | 2/2011 |

OTHER PUBLICATIONS

An Office Action issued by the Taiwan Intellectual Property Office on Jul. 30, 2014, which corresponds to Taiwanese Patent Application No. 101137255 and is related to U.S. Appl. No. 13/661,898; with English language translation.

The first Office Action issued by the State Intellectual Property Office of People's Republic of China on Aug. 13, 2014, which corresponds to Chinese Patent Application No. 201210434198.5 and is related to U.S. Appl. No. 13/661,898.

* cited by examiner

COAXIAL CONNECTOR PLUG

CROSS REFERENCE TO RELATED APPLICATIONS

The present application claims priority to Japanese Patent Application No. 2011-242324 filed on Nov. 4, 2011, the entire contents of this application being incorporated herein by reference in their entirety.

TECHNICAL FIELD

The technical field relates to a coaxial connector plug, and more specifically to a coaxial connector plug including a substantially tubular outer conductor and a substantially tubular center conductor provided inside the outer conductor.

BACKGROUND

A connector plug described in Japanese Unexamined Patent Application Publication No. 2009-104836, for example, is known as a coaxial connector plug according to the related art. FIG. 14 is a cross-sectional view showing the structure of a connector plug 510 described in Japanese Unexamined Patent Application Publication No. 2009-104836.

As shown in FIG. 14, the connector plug 510 includes a socket-shaped center conductor 512, a center conductor joint portion 514, an outside conductor 516, and an insulating housing 518. The outside conductor 516 has a substantially cylindrical shape extending in the up-down direction, and is kept at a ground potential. The socket-shaped center conductor 512 is provided at the center of the outside conductor 516, and has a substantially cylindrical shape extending in the up-down direction. A high-frequency signal is input to and output from the socket-shaped center conductor 512. The center conductor joint portion 514 is connected to the socket-shaped center conductor 512, and extends in the horizontal direction. The insulating housing 518 is a resin member that fixes the socket-shaped center conductor 512 at the center of the outside conductor 516.

It is difficult to lower the profile of the connector plug 510 described in Japanese Unexamined Patent Application Publication No. 2009-104836. Specifically, a receptacle connector is mounted to the connector plug 510. In this event, a pin-shaped center conductor of the receptacle connector is inserted into the socket-shaped center conductor 512 from the upper side. Therefore, the socket-shaped center conductor 512 is pressed downward. Accordingly, the socket-shaped center conductor 512 may be displaced downward.

Thus, in the connector plug 510, a portion of connection between the socket-shaped center conductor 512 and the center conductor joint portion 514 is cranked. This allows the insulating housing 518 to be positioned under the socket-shaped center conductor 512, which suppresses downward displacement of the socket-shaped center conductor 512 because of the presence of the insulating housing 518 even if the socket-shaped center conductor 512 is pressed downward.

SUMMARY

The present disclosure provides a coaxial connector plug that can achieve a reduction in profile while suppressing displacement of a center conductor.

A coaxial connector plug according to an embodiment of the present disclosure includes a first outer conductor formed in a substantially tubular shape extending in an axial direction, a first center conductor formed in a substantially tubular shape extending in the axial direction and provided inside the first outer conductor, and an insulator that fixes the first center conductor relative to the first outer conductor. The first center conductor is provided with a communication portion that communicates with inside and outside of the first center conductor. The insulator extends to the inside of the first center conductor from the outside via the communication portion.

Other features, elements, characteristics and advantages of the present disclosure will become more apparent from the following detailed description of exemplary embodiments with reference to the attached drawings.

DETAILED DESCRIPTION

The inventors realized that in a connector plug 510 such as described in Japanese Unexamined Patent Application Publication No. 2009-104836, presence of the insulating housing 518 under the socket-shaped center conductor 512 increases the height of the connector plug 510 by an amount corresponding to the height of the insulating housing 518. That is, it is difficult to lower the profile of the connector plug 510 described in Japanese Unexamined Patent Application Publication No. 2009-104836.

A coaxial connector plug according to an exemplary embodiment of the present disclosure will now be described with reference to FIGS. 1-8.

Figure 1:
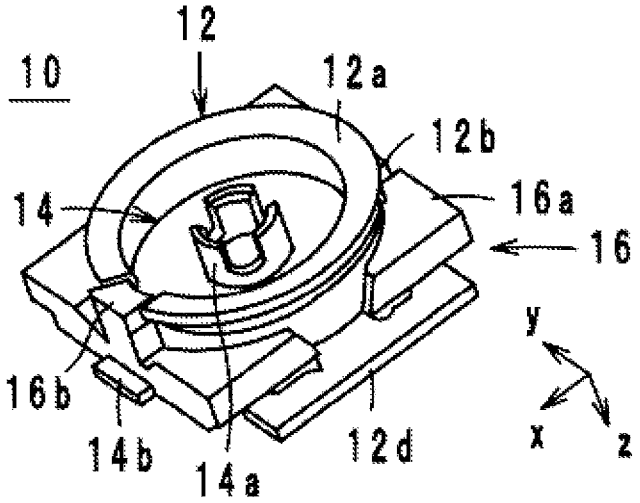
FIG. 1 is a perspective view showing the appearance of a coaxial connector plug according to an exemplary embodiment.
Figure 2:
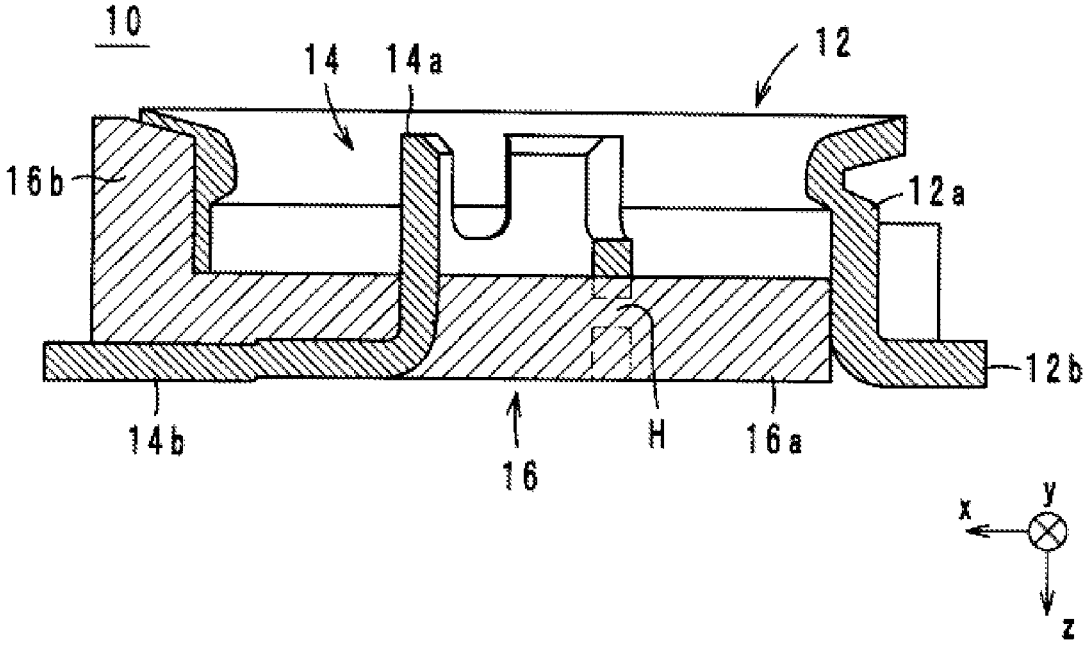
FIG. 2 is a cross-sectional view showing the structure of the coaxial connector plug shown in FIG. 1.
Figure 3:
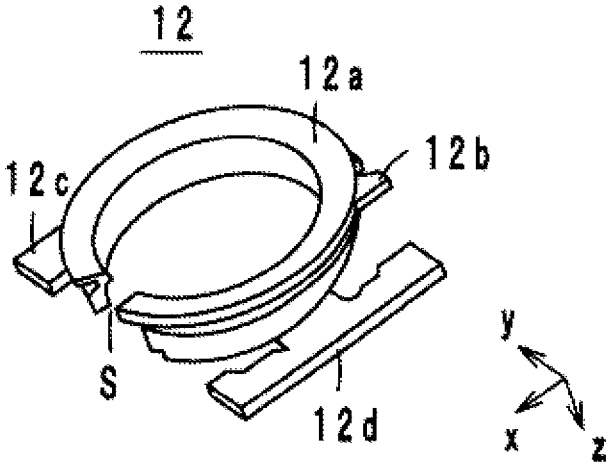
FIG. 3 is a perspective view showing the appearance of an outer conductive portion of the coaxial connector plug shown in FIG. 1.
Figure 4:
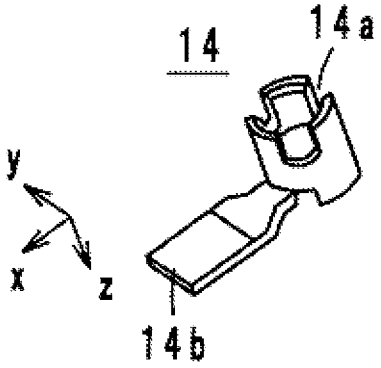
FIG. 4 is a perspective view showing the appearance of a center conductive portion of the coaxial connector plug shown in FIG. 1.
Figure 5:
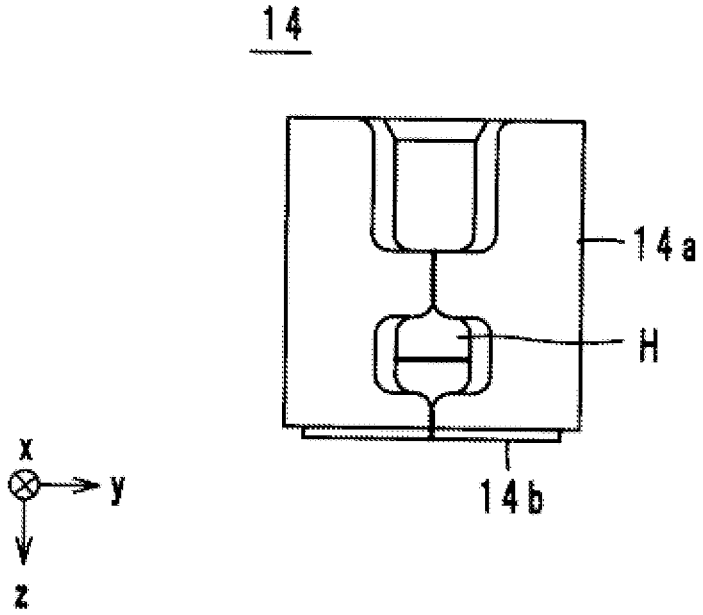
FIG. 5 is a front view of the center conductive portion of the coaxial connector plug shown in FIG. 1.
Figure 6A:
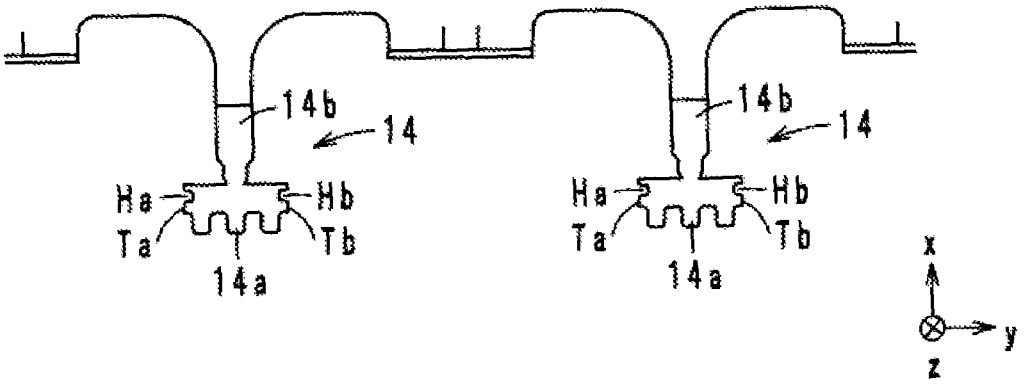
FIGS. 6A and 6B show the center conductive portion of the coaxial connector plug in the middle of assembly.
Figure 6B:
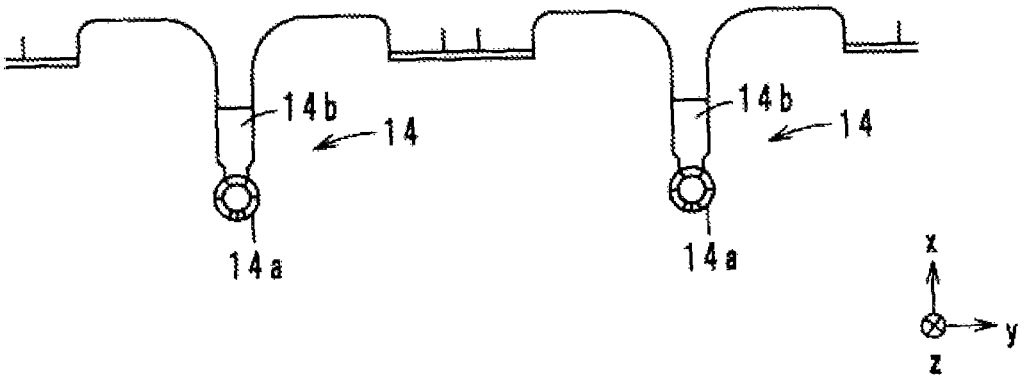
Figure 7:
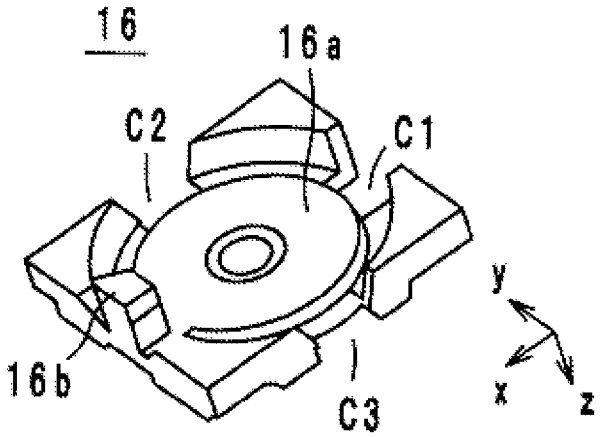
FIG. 7 is a perspective view showing the appearance of an insulator of the coaxial connector plug shown in FIG. 1.
Figure 8:
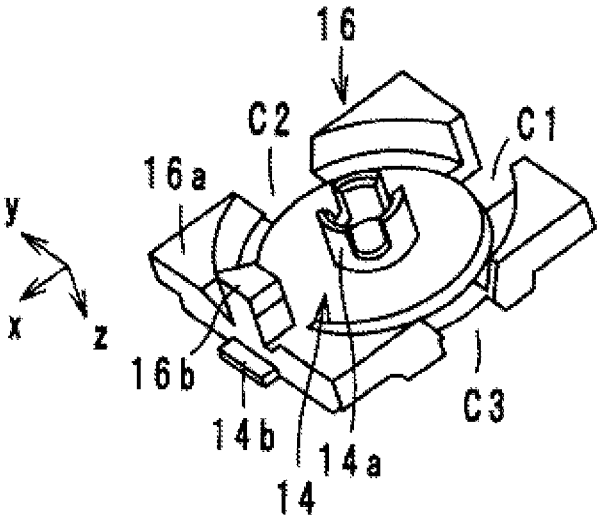
FIG. 8 is a perspective view showing the appearance of the center conductive portion and the insulator as assembled.

FIG. 1 is a perspective view showing the appearance of a coaxial connector plug 10 according to an exemplary embodiment. FIG. 2 is a cross-sectional view showing the structure of the coaxial connector plug 10. FIG. 3 is a perspective view showing the appearance of an outer conductive portion 12 of the coaxial connector plug 10. FIG. 4 is a perspective view showing the appearance of a center conductive portion 14 of the coaxial connector plug 10. FIG. 5 is a front view of the center conductive portion 14 of the coaxial connector plug 10. FIGS. 6A and 6B show the center conductive portion 14 of the coaxial connector plug 10 in the middle of assembly. FIG. 7 is a perspective view showing the appearance of an insulator 16 of the coaxial connector plug 10. FIG. 8 is a perspective view showing the appearance of the center conductive portion 14 and the insulator 16 as assembled.

In the following description, in FIG. 1, the direction of the normal to the insulator 16 is defined as a "z-axis direction", and the directions parallel to the two sides of the insulator 16 as viewed from the z-axis direction are defined as an "x-axis direction" and a "y-axis direction". The x-axis direction, the y-axis direction, and the z-axis direction are orthogonal to each other. The z-axis direction is parallel to the direction of the plumb line.

A coaxial connector receptacle to be discussed later is mounted to the coaxial connector plug 10 from the lower side. That is, the coaxial connector plug 10 is used with its opening facing downward. Thus, the lower side of FIG. 1 corresponds to the upper side in the direction of the plumb line, and the upper side of FIG. 1 corresponds to the lower side in the direction of the plumb line. Therefore, the lower side of FIG. 1 is defined as a "positive side" in the z-axis direction, and the upper side of FIG. 1 is defined as a "negative side" in the z-axis direction.

The coaxial connector plug 10 is mounted on a surface of a circuit board such as a flexible printed board, and includes the outer conductive portion 12, the center conductive portion 14, and the insulator 16 as shown in FIGS. 1 and 2.

The outer conductive portion 12 can be fabricated by performing a punching process and a bending process on a single metal plate (made of phosphor bronze, for example) having conductivity and elasticity. Further, the outer conductive portion 12 can be plated with silver or gold. As shown in FIGS. 1 and 3, the outer conductive portion 12 includes an outer conductor 12*a* and outer terminals 12*b* to 12*d*. As shown in FIGS. 1 to 3, the outer conductor 12*a* has a substantially cylindrical shape extending in the z-axis direction.

A slit S is formed in the outer conductor 12*a*. The slit S is provided to linearly connect an end portion of the outer conductor 12*a* on the positive side in the z-axis direction and an end portion of the outer conductor 12*a* on the negative side in the z-axis direction. Thus, the outer conductor 12*a* is substantially C-shaped, rather than being continuous to form a substantially annular shape, in plan view from the negative side in the z-axis direction.

The outer terminals 12*b* to 12*d* are connected to the outer conductor 12*a*, and provided on the positive side in the z-axis direction with respect to the outer conductor 12*a*. The outer terminal 12*b* extends from the outer conductor 12*a* toward the positive side in the z-axis direction, and is bent toward the negative side in the x-axis direction. The outer terminal 12*c* extends from the outer conductor 12*a* toward the positive side in the z-axis direction, and is bent toward the positive side in the y-axis direction. The outer terminal 12*c* is substantially T-shaped in plan view from the z-axis direction. The outer terminal 12*d* extends from the outer conductor 12*a* toward the positive side in the z-axis direction, and is bent toward the negative side in the y-axis direction. The outer terminal 12*d* is substantially T-shaped in plan view from the z-axis direction.

The center conductive portion 14 can be fabricated by performing a punching process and a bending process on a single metal plate (made of phosphor bronze, for example). Further, the center conductive portion 14 can be plated with silver or gold. As shown in FIGS. 1 and 4, the center conductive portion 14 includes a center conductor 14*a* and an outer terminal 14*b*.

As shown in FIG. 1, the center conductor 14*a* is provided inside the outer conductor 12*a* (more specifically, at the center of the outer conductor 12*a*). That is, the center conductor 14*a* is surrounded by the outer conductor 12*a* in plan view from the z-axis direction. As shown in FIG. 4, the center conductor 14*a* has a substantially cylindrical shape extending in the z-axis direction. The center conductor 14*a* has three slits extending in the up-down direction. This enables the center conductor 14*a* to be slightly expanded in the horizontal direction.

As shown in FIG. 4, the outer terminal 14*b* is connected to an end portion of the center conductor 14*a* on the positive side in the z-axis direction, and extends linearly along the positive side in the x-axis direction (in a direction orthogonal to the center axis of the center conductor 14*a*). Note that as shown in FIG. 2, the outer terminal 14*b* has a small step, for example, of about 0.01 mm. Hence, as shown in FIG. 2, the outer terminal 14*b* lies beyond a surface of the insulator 16 on the positive side in the z-axis direction by about 0.01 mm. As shown in FIG. 1, the outer terminal 14*b* is located opposite the outer terminal 12*b* across the center of the outer conductor 12*a* in plan view from the z-axis direction.

As shown in FIG. 5, a hole (communication portion) H that communicates with the inside and the outside of the center conductor 14*a* is formed in a portion of a side surface of the center conductor 14*a* on the negative side in the x-axis direction. The following describes the hole H along with an exemplary process of manufacturing the center conductive portion 14.

In fabricating the center conductive portion 14, as shown in FIG. 6A, a single metal plate is punched into a substantially T shape. In the state of FIG. 6A, the center conductor 14*a* is a substantially flat member extending in the y-axis direction. Notches Ha and Hb are formed on respective sides of the center conductor 14*a* at both ends in the y-axis direction. In the state of FIG. 6A, in addition, the outer terminal 14*b* is a substantially flat member extending from the center of the center conductor 14*a* in the y-axis direction toward the positive side in the x-axis direction. A plurality of center conductive portions 14 are connected to the metal plate at respective end portions of the outer terminals 14*b* on the positive side in the x-axis direction so that the plurality of center conductive portions 14 are arranged in the y-axis direction.

Next, as shown in FIG. 6B, the substantially flat center conductor 14*a* is curved to be substantially cylindrical. Specifically, the substantially flat center conductor 14*a* is curved into a substantially annular shape such that sides of the center conductor 14*a* at both ends in the y-axis direction are joined to each other. In this event, the notches Ha and Hb are connected to each other, or formed to face each other, to form the hole H. Further, as shown in FIG. 6B, the cylindrical center conductor 14*a* is bent toward the negative side in the z-axis direction. The center conductive portion 14 is thus completed.

The insulator 16 is a base member fabricated from an insulating material such as a resin, and serves to fix the center conductive portion 14 to the outer conductive portion 12. As shown in FIGS. 1 and 7, the insulator 16 includes a base portion 16*a* and a projection 16*b*. The base portion 16*a* is substantially rectangular in plan view from the z-axis direction, and covers an opening of the outer conductor 12*a* on the positive side in the z-axis direction as shown in FIG. 2. Note that the base portion 16*a* is provided with notches C1 to C3. The notch C1 can be formed by removing the center portion of a side of the base portion 16*a* on the negative side in the x-axis direction. The notch C2 can be formed by removing the center portion of a side of the base portion 16*a* on the positive side in the y-axis direction. The notch C3 can be formed by removing the center portion of a side of the base portion 16*a* on the negative side in the y-axis direction.

The projection 16*b* is formed by the center portion of a side of the base portion 16*a* on the positive side in the x-axis direction projecting on the negative side in the z-axis direction.

As shown in FIG. 8, the center conductive portion 14 and the insulator 16 are integrally formed by insert molding. The center conductor 14*a* is thus projected from the center of the base portion 16*a* toward the negative side in the z-axis direction. In addition, as shown in FIG. 2, the center conductor 14*a* is exposed from a surface of the insulator 16 on the negative side in the z-axis direction. Further, on the positive side in the z-axis direction with respect to the projection 16*b*, the outer terminal 14*b* of the center conductive portion 14 extends from the insulator 16 toward the positive side in the x-axis direction.

Further, as shown in FIG. 2, the insulator 16 is provided around the center conductor 14*a*, and enters the inside of the center conductor 14*a* from the outside via the hole H. That is, the insulator 16 enters an area surrounded by the inner peripheral surface or wall of the center conductor 14*a* and is also formed on the outer peripheral surface or wall of the center conductor 14*a*. This allows the center conductive portion 14 to be firmly fixed to the insulator 16.

The outer conductive portion 12 is attached to the insulator 16. Specifically, the outer terminals 12*b* to 12*d* extend toward the positive side in the z-axis direction with respect to the insulator 16 via the notches C1 to C3, respectively. An opening of the outer conductor 12*a* on the positive side in the z-axis direction is covered by the base portion 16*a* of the insulator 16. As shown in FIG. 1, the projection 16*b* is positioned in the slit S. That is, the projection 16*b* functions as a lid member to block the slit S. It should be noted, however, that the projection 16*b* does not contact the outer conductor 12*a*. That is, a slight gap is present between the projection 16*b* and the outer conductor 12*a*. This allows the outer conductor 12*a* to be slightly deformed in the direction of reducing its diameter.

Figure 9:
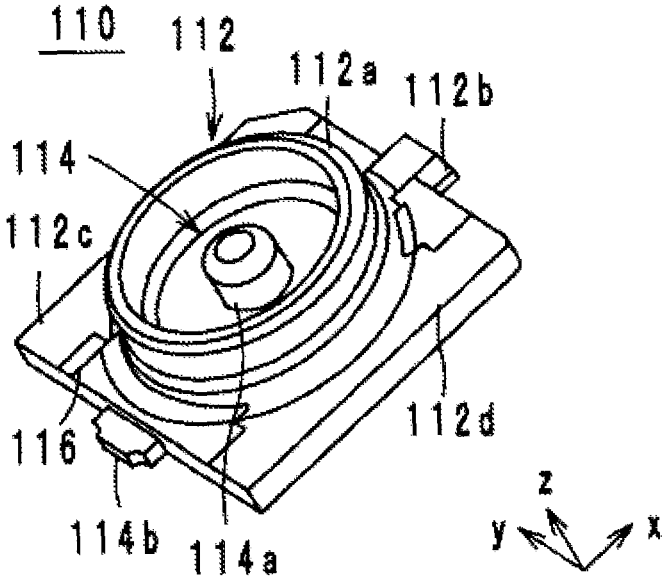
FIG. 9 is a perspective view showing the appearance of a coaxial connector receptacle according to an exemplary embodiment.
Figure 10:
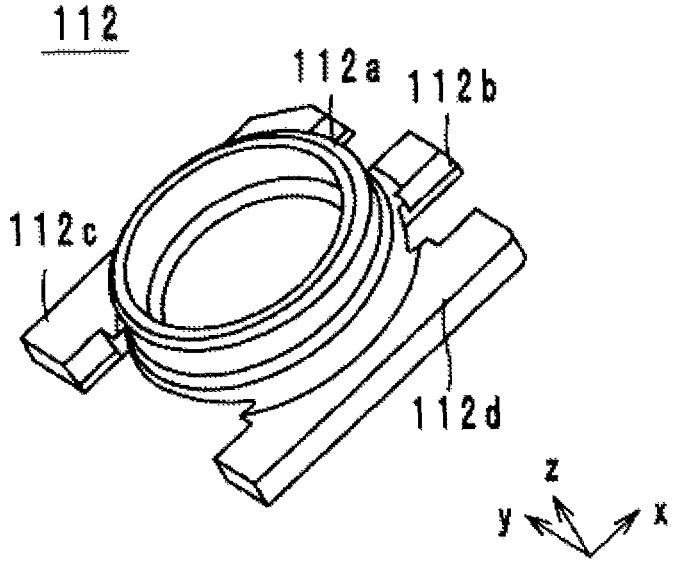
FIG. 10 is a perspective view showing the appearance of an outer conductive portion of the coaxial connector receptacle shown in FIG. 9.
Figure 11:
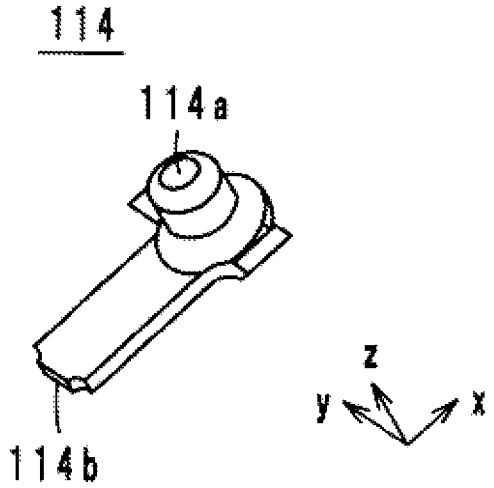
FIG. 11 is a perspective view showing the appearance of a center conductive portion of the coaxial connector receptacle shown in FIG. 9.
Figure 12:
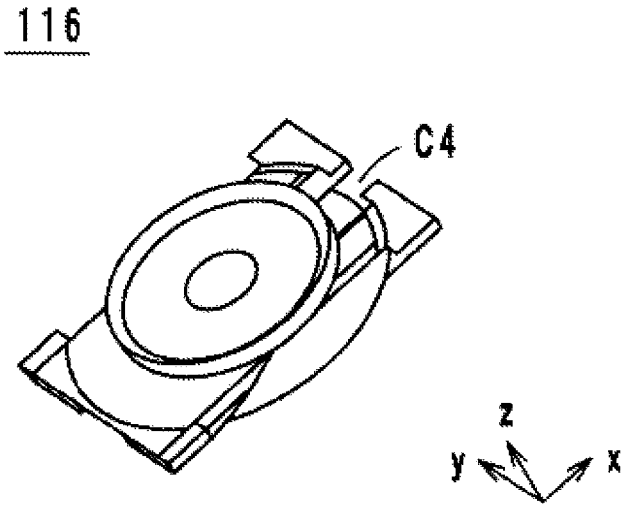
FIG. 12 is a perspective view showing the appearance of an insulator of the coaxial connector receptacle shown in FIG. 9.

A coaxial connector receptacle to be detachably mounted to the coaxial connector plug 10 according to an exemplary embodiment will now be described with reference to the drawings. FIG. 9 is a perspective view showing the appearance of a coaxial connector receptacle 110 according to an exemplary embodiment of the present invention. FIG. 10 is a perspective view showing the appearance of an outer conductive portion 112 of the coaxial connector receptacle 110. FIG. 11 is a perspective view showing the appearance of a center conductive portion 114 of the coaxial connector receptacle 110. FIG. 12 is a perspective view showing the appearance of an insulator 116 of the coaxial connector receptacle 110.

In the following description, in FIG. 9, the direction of the normal to the insulator 116 is defined as a "z-axis direction", and the directions parallel to the two sides of the insulator 116 as viewed from the z-axis direction are defined as an "x-axis direction" and a "y-axis direction". The x-axis direction, the y-axis direction, and the z-axis direction are orthogonal to each other. The z-axis direction is parallel to the direction of the plumb line.

The coaxial connector receptacle 110 is mounted to the coaxial connector plug 110 from the lower side. That is, the coaxial connector receptacle 110 is used with its opening facing upward. Thus, the upper side of FIG. 9 corresponds to the upper side in the direction of the plumb line, and the lower side of FIG. 9 corresponds to the lower side in the direction of the plumb line. Therefore, the upper side of FIG. 9 is defined as a "positive side" in the z-axis direction, and the lower side of FIG. 9 is defined as a "negative side" in the z-axis direction.

The coaxial connector receptacle 110 can be mounted on a surface of a circuit board such as a glass epoxy printed board, and includes the outer conductive portion 112, the center conductive portion 114, and the insulator 116 as shown in FIG. 9.

The outer conductive portion 112 can be fabricated by performing a punching process and a bending process on a single metal plate (made of phosphor bronze, for example) having conductivity and elasticity. Further, the outer conductive portion 112 can be plated with silver or gold. As shown in FIGS. 9 and 10, the outer conductive portion 112 includes an outer conductor 112*a* and outer terminals 112*b* to 112*d*. As shown in FIGS. 9 and 10, the outer conductor 112*a* has a substantially cylindrical shape extending in the z-axis direction.

The outer terminals 112*b* to 112*d* are connected to the outer conductor 112*a*, and provided on the negative side in the z-axis direction with respect to the outer conductor 112*a*. The outer terminal 112*b* extends from the outer conductor 112*a* toward the negative side in the z-axis direction, and is bent toward the positive side in the x-axis direction. The outer terminal 112*c* extends from the outer conductor 112*a* toward the negative side in the z-axis direction, and is bent toward the positive side in the y-axis direction. The outer terminal 112*c* is substantially T-shaped in plan view from the z-axis direction. The outer terminal 112*d* extends from the outer conductor 112*a* toward the negative side in the z-axis direction, and is bent toward the negative side in the y-axis direction. The outer terminal 112*d* is substantially T-shaped in plan view from the z-axis direction.

The center conductive portion 114 can be fabricated by performing a punching process and a bending process on a single metal plate (made of phosphor bronze, for example). Further, the center conductive portion 114 can be plated with silver or gold. As shown in FIGS. 9 and 11, the center conductive portion 114 includes a center conductor 114*a* and an outer terminal 114*b*.

As shown in FIG. 9, the center conductor 114*a* is provided to extend in the z-axis direction at the center of the outer conductor 112*a*. That is, the center conductor 114*a* is surrounded by the outer conductor 112*a* in plan view from the z-axis direction. As shown in FIG. 11, the center conductor 114*a* has a substantially columnar shape extending in the z-axis direction.

As shown in FIG. 11, the outer terminal 114*b* is connected to an end portion of the center conductor 114*a* on the negative side in the z-axis direction, and extends toward the negative side in the x-axis direction. As shown in FIG. 9, the outer terminal 114*b* is located opposite the outer terminal 112*b* across the center of the outer conductor 112*a* in plan view from the z-axis direction.

The insulator 116 is fabricated from an insulating material such as a resin, and is substantially rectangular in plan view from the z-axis direction as shown in FIGS. 9 and 12. Note that the insulator 116 is provided with a notch C4. The notch C4 can be formed by removing the center portion of a side of the insulator 116 on the positive side in the x-axis direction.

The outer conductive portion 112, the center conductive portion 114, and the insulator 116 can be integrally formed by insert molding. The outer conductor 112*a* is thus projected from the center of the insulator 116 toward the positive side in the z-axis direction. Further, an end portion of the outer conductor 112*a* on the negative side in the z-axis direction is covered by the insulator 116. The outer terminal 112*b* extends to the outside of the insulator 116 via the notch C4. Further, the outer terminals 112*c* and 112*d* extend from a side of the insulator 116 on the positive side in the y-axis direction and a side of the insulator 116 on the negative side in the y-axis direction, respectively, to the outside of the insulator 116. The center conductor 114*a* projects from the insulator 116 toward the positive side in the z-axis direction in a region surrounded by the outer conductor 112*a*. The outer terminal 114*b* extends from the insulator 116 toward the negative side in the x-axis direction.

Figure 13A:
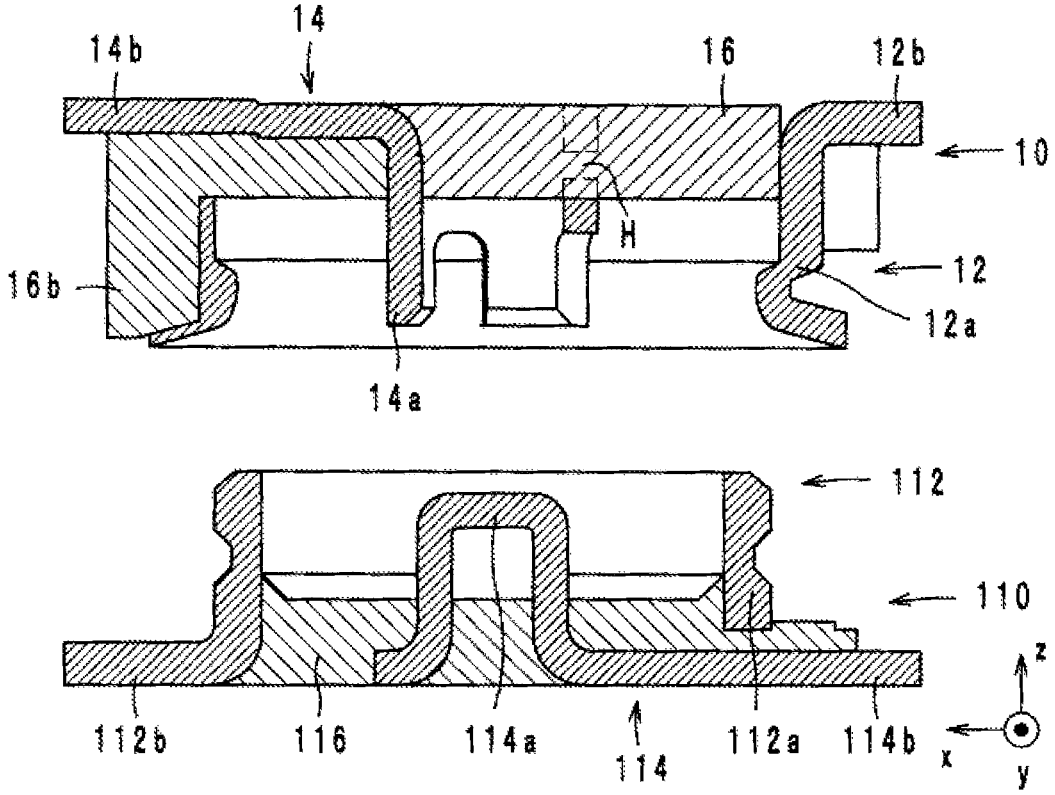
FIG. 13A is a cross-sectional view showing the structure of an exemplary coaxial connector plug and an exemplary coaxial connector receptacle before being attached to each other.
Figure 13B:
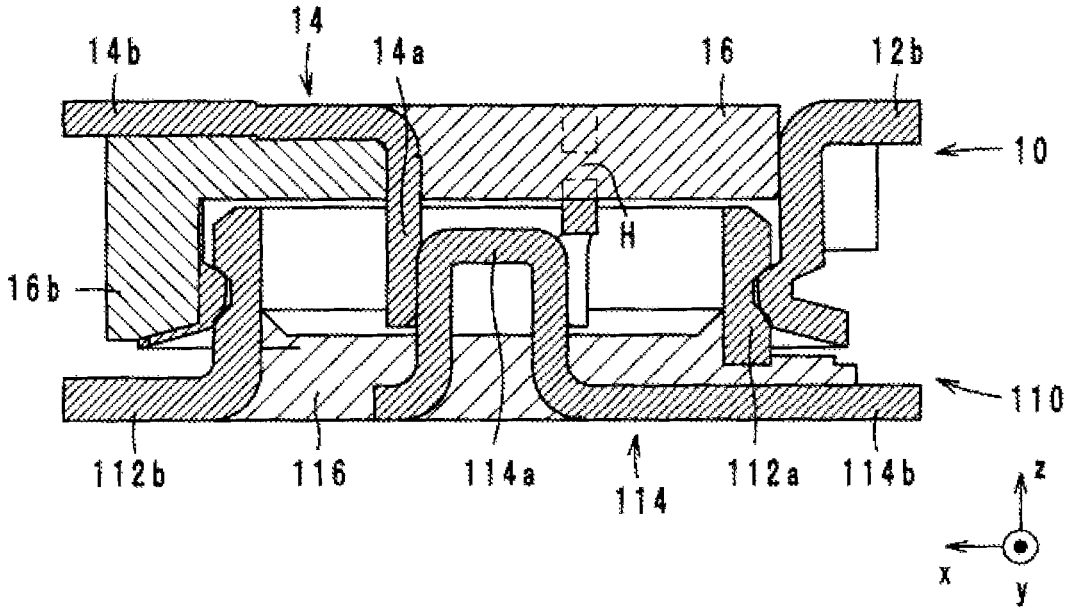
FIG. 13B is a cross-sectional view showing the structure of the coaxial connector plug and the coaxial connector receptacle shown in FIG. 13A after being attached to each other.
Figure 14:
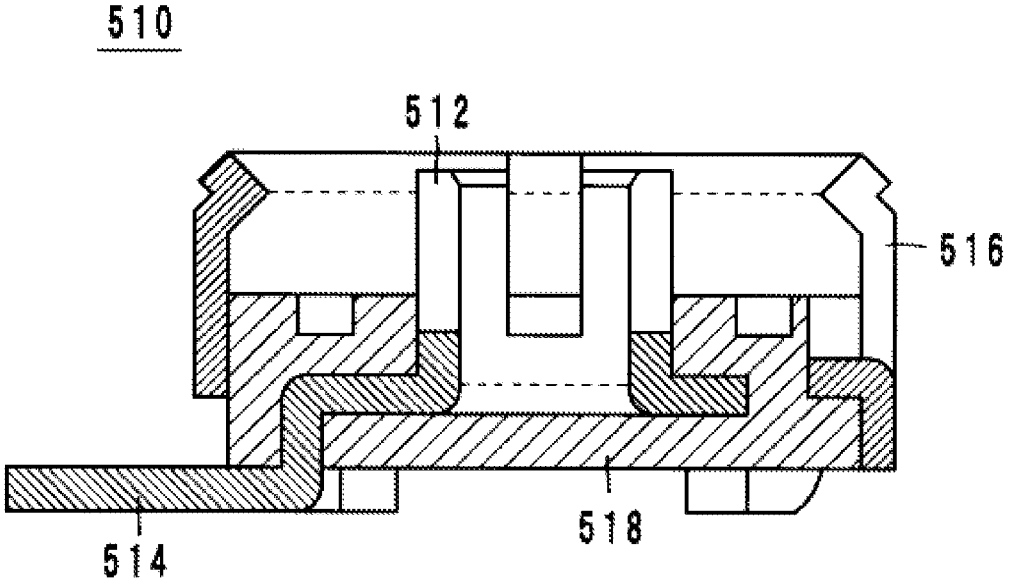
FIG.14 Prior Art
FIG. 14 is a cross-sectional view showing the structure of a connector plug described in Japanese Unexamined Patent Application Publication No. 2009-104836.

Attachment of the coaxial connector receptacle 110 to the coaxial connector plug 10 will now be described with reference to the drawings. FIG. 13A is a cross-sectional view showing the structure of the coaxial connector plug 10 and the coaxial connector receptacle 110 before being attached to each other. FIG. 13B is a cross-sectional view showing the structure of the coaxial connector plug 10 and the coaxial connector receptacle 110 after being attached to each other.

As shown in FIG. 13A, the coaxial connector plug 10 is used with the opening of the outer conductor 12*a* facing the negative side in the z-axis direction. Then, as shown in FIG. 13B, the coaxial connector receptacle 110 is mounted to the coaxial connector plug 110 from the negative side in the z-axis direction. Specifically, the outer conductor 112*a* is inserted into the outer conductor 12*a* from the negative side in the z-axis direction. The diameter of the outer peripheral surface of the outer conductor 112*a* is designed to be slightly larger than the diameter of the inner peripheral surface of the outer conductor 12*a*. Therefore, the outer peripheral surface of the outer conductor 112*a* is brought into pressure contact with the inner peripheral surface of the outer conductor 12*a*, and the outer conductor 12*a* is pressed to be flexibly expanded in the horizontal direction by the outer conductor 112*a*. That is, the outer conductor 12*a* is expanded such that the width of the entire slit S becomes larger. Then, projections and depressions on the inner peripheral surface of the outer conductor 12*a* and projections and depressions on the outer peripheral surface of the outer conductor 112*a* engage each other. This allows the outer conductor 12*a* to hold the outer conductor 112*a*. The outer conductors 12*a* and 112*a* are kept at a grounding potential during use.

Further, the center conductor 14*a* is physically and electrically connected to the center conductor 114*a*. Specifically, as shown in FIG. 13B, the center conductor 114*a* is inserted into the substantially cylindrical center conductor 14*a*. The diameter of the outer peripheral surface of the center conductor 114*a* is designed to be slightly larger than the diameter of the inner peripheral surface of the center conductor 14*a*. Therefore, the outer peripheral surface of the center conductor 114*a* is brought into pressure contact with the inner peripheral surface of the center conductor 14*a*, and the center conductor 14*a* is pressed to be expanded so as to be warped in the horizontal direction by the center conductor 114*a*. This allows the center conductor 14*a* to hold the center conductor 114*a*. A signal current flows through the center conductors 14*a* and 114*a* during use.

In embodiments according to the coaxial connector plug 10 configured as described above, it is possible to achieve a reduction in profile while suppressing displacement of the center conductor 14*a*. More specifically, the center conductor 14*a* is provided with the hole H that communicates with the inside and the outside of the center conductor 14*a*, and the insulator 16 enters the inside of the center conductor 14*a* from the outside via the hole H. This allows the center conductor 14*a* to be firmly fixed to the insulator 16, which suppresses detachment of the center conductor 14*a* from the insulator 16 when the coaxial connector receptacle 110 is mounted. Further, the center conductive portion 14 is fixed by a part of the insulator 16 filling the hole H provided in a side surface of the substantially cylindrical center conductor 14*a*. Thus, the insulator 16 might not be provided on the positive side in the z-axis direction with respect to the center conductor 14*a*. This allows a reduction in profile of the coaxial connector plug 10.

In the coaxial connector plug 10, in addition, the center conductor 14*a* is fixed to the insulator 16 by a part of the insulator 16 filling the hole H. This suppresses displacement of the center conductive portion 14*a* when the coaxial connector receptacle 110 is detached from the coaxial connector plug 10.

A coaxial connector plug according to the present disclosure is not limited to the coaxial connector plug 10 according to the exemplary embodiment described above, and may be changed without departing from the scope of the present disclosure.

In the coaxial connector plug 10, the hole H is formed in the center conductor 14*a* to allow entry of the insulator 16 to the inside of the center conductor 14*a*. However, the insulator 16 may enter the center conductor 14*a* via a communication portion other than the hole H that communicates with the inside and the outside of the center conductor 14*a*. For example, a notch may be provided at an end portion of the center conductor 14*a* on the positive side in the z-axis direction, and the insulator 16 may enter the center conductor 14*a* via the notch.

The hole H is formed by connecting the notches Ha and Hb to each other as shown in FIG. 6A. However, the hole H may be formed by providing at least one of the notches Ha and Hb.

As has been described above, embodiments consistent with the present disclosure are useful for coaxial connector plugs, and excellent in particular in achieving a reduction in profile while suppressing displacement of a center conductor.

While exemplary embodiments of the invention have been described above, it is to be understood that variations and modifications will be apparent to those skilled in the art without departing from the scope and spirit of the disclosure.

What is claimed is:

1. A coaxial connector plug comprising:

a first outer conductor formed in a substantially tubular shape extending in an axial direction;

a first center conductor formed in a substantially annular shape extending in the axial direction that has slits which enable the first conductor to be expanded in a direction perpendicular to the axial direction and provided inside the first outer conductor; and an insulator that fixes the first center conductor relative to the first outer conductor, wherein the first center conductor is provided with a communication portion that communicates with inside and outside of the first center conductor, and the insulator extends to the inside of the first center conductor from outside the first center conductor via the communication portion and does not extend to a bottom surface of the first center conductor, the communication portion is a hole provided in the first center conductor, the first center conductor has a substantially plate-shaped member being curved to be the substantially annular shape such that both ends of the substantially plate-shaped member are joined to each other, and the hole is formed by providing a notch in at least one of the both ends of the substantially plate-shaped member.

2. The coaxial connector plug according to claim 1, wherein the first center conductor is substantially cylindrical.

3. The coaxial connector plug according to claim 1, wherein the insulator covers an opening of the first outer conductor, and an end of the first center conductor is exposed from a surface of the insulator.

4. The coaxial connector plug according to claim 1, wherein the insulator is fabricated from a resin.

5. The coaxial connector plug according to claim 1, further comprising:

an outer terminal connected to the first center conductor and extending linearly along a direction orthogonal to the axial direction.

6. The coaxial connector plug according to claim 1, wherein the first outer conductor is configured to insert a second outer conductor in a substantially tubular shape of a coaxial connector receptacle, and the first center conductor is configured to insert a second center conductor of the coaxial connector receptacle.

7. The coaxial connector plug according to claim 3, further comprising:

an outer terminal connected to the first center conductor and extending linearly along a direction orthogonal to the axial direction.

8. The coaxial connector plug according to claim 4, wherein the first outer conductor is configured to insert a second outer conductor in a substantially tubular shape of a coaxial connector receptacle, and the first center conductor is configured to insert a second center conductor of the coaxial connector receptacle.

9. The coaxial connector plug according to claim 2, wherein the first outer conductor is configured to insert a second outer conductor in a substantially tubular shape of a coaxial connector receptacle, and the first center conductor is configured to insert a second center conductor of the coaxial connector receptacle.

10. The coaxial connector plug according to claim 5, wherein the first outer conductor is configured to insert a second outer conductor in a substantially tubular shape of a coaxial connector receptacle, and the first center conductor is configured to insert a second center conductor of the coaxial connector receptacle.

11. The coaxial connector plug according to claim 3, wherein the first outer conductor is configured to insert a second outer conductor in a substantially tubular shape of a coaxial connector receptacle, and the first center conductor is configured to insert a second center conductor of the coaxial connector receptacle.

* * * * *